US012378651B2

(12) United States Patent
Maeda et al.

(10) Patent No.: US 12,378,651 B2
(45) **Date of Patent: *Aug. 5, 2025**

(54) HOT STAMPED BODY

(71) Applicant: NIPPON STEEL CORPORATION, Tokyo (JP)

(72) Inventors: Daisuke Maeda, Tokyo (JP); Shingo Fujinaka, Tokyo (JP); Yuri Toda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 478 days.

This patent is subject to a terminal disclaimer.

(21) Appl. No.: 17/777,238

(22) PCT Filed: Jan. 15, 2021

(86) PCT No.: PCT/JP2021/001320

§ 371 (c)(1),
(2) Date: May 16, 2022

(87) PCT Pub. No.: WO2021/145442

PCT Pub. Date: Jul. 22, 2021

(65) Prior Publication Data

US 2022/0403492 A1 Dec. 22, 2022

(30) Foreign Application Priority Data

Jan. 16, 2020 (JP) ..... 2020-004884

(51) Int. Cl.
*C22C 38/58* (2006.01)
*B21D 22/02* (2006.01)
(Continued)

(52) U.S. Cl.
CPC ..... *C22C 38/58* (2013.01); *B21D 22/022* (2013.01); *C21D 9/46* (2013.01); *C22C 38/002* (2013.01);
(Continued)

(58) Field of Classification Search
CPC ..... C22C 38/58; C22C 38/002; C22C 38/005; C22C 38/02; C22C 38/06; C22C 38/44;
(Continued)

(56) References Cited

U.S. PATENT DOCUMENTS

2010/0221572 A1 9/2010 Laurent et al.
2010/0314009 A1 12/2010 Kaneko et al.
(Continued)

FOREIGN PATENT DOCUMENTS

CN 101932742 A 12/2010
CN 102348821 A 2/2012
(Continued)

*Primary Examiner* — Danielle M. Carda
(74) *Attorney, Agent, or Firm* — Birch, Stewart, Kolasch & Birch, LLP

(57) ABSTRACT

A hot stamped body with high strength, good bendability and crack propagation resistance, consisting of: in mass %, C: 0.06% or more to less than 0.20%, Si: 0.010-1.00%, Mn: 0.80-2.00%, P: 0.100% or less, S: 0.010% or less, Al: 0.010-0.500%, N: 0.010% or less, Nb: more than 0.020% to 0.10% or less, Ti: 0-0.10%, V: 0-0.10%, Cr: 0-0.50%, Mo: 0-1.00%, B: 0-0.0100%, Ni: 0-0.50%, REM: 0-0.0100%, Mg: 0-0.010%, Ca: 0-0.0100%, and Co: 0-2.0%, with the balance: Fe and impurities, wherein a microstructure includes, in area fraction, ferrite: 5-50%, and martensite: 50-95%, a proportion of regions in the martensite where GAIQ values are 35000 or more to less than 45000 is 30 area % or more, and a maximum bending angle α (deg) is 90 or more.

17 Claims, 3 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/005* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01); *C21D 2211/008* (2013.01)

(58) Field of Classification Search
CPC ..... C22C 38/46; C22C 38/48; C22C 38/50; C22C 38/52; C22C 38/54; C22C 38/04; C22C 38/08; C22C 38/10; C22C 38/12; C22C 38/14; C22C 38/26; C22C 38/32; C22C 38/38; C22C 38/105; C22C 38/22; C22C 38/24; C22C 38/28; C22C 38/30; C22C 38/001; B21D 22/022; C21D 9/46; C21D 2211/005; C21D 2211/008; C21D 1/673; C21D 7/13; C21D 1/18; C21D 8/0226; C21D 8/0205; C23C 2/06; C23C 2/12
USPC ..... 420/106
See application file for complete search history.

(56) References Cited

U.S. PATENT DOCUMENTS

| | | | | |
|---|---|---|---|---|
| 2011/0315279 | A1 | 12/2011 | Kaneko et al. | |
| 2014/0242416 | A1 | 8/2014 | Matsuda et al. | |
| 2016/0060722 | A1 | 3/2016 | Suwa et al. | |
| 2016/0122845 | A1* | 5/2016 | Akiba | C21D 8/0226 148/330 |
| 2016/0319385 | A1 | 11/2016 | Hasegawa et al. | |
| 2021/0040592 | A1 | 2/2021 | Toda et al. | |
| 2022/0403490 | A1* | 12/2022 | Fujinaka | C21D 6/008 |

FOREIGN PATENT DOCUMENTS

| | | | | |
|---|---|---|---|---|
| CN | 103857819 | A | | 6/2014 |
| CN | 105074038 | A | | 11/2015 |
| CN | 105814227 | A | | 7/2016 |
| JP | 2010-521584 | A | | 6/2010 |
| JP | 2015081368 | A | * | 4/2015 |
| JP | 2018-527457 | A | | 9/2018 |
| WO | WO 2017/006159 | A1 | | 1/2017 |
| WO | WO 2019/186931 | A1 | | 10/2019 |

* cited by examiner

HOT STAMPED BODY

TECHNICAL FIELD

The present invention relates to a hot stamped body.

BACKGROUND ART

Collision safety standards for automobiles have been increasingly stringent, and automobile members are required to have an improved collision performance. For improvement of the collision performance, there are a deformation suppressing member that does not deform and keep a shape as the member even when receiving a collision and an impact absorbing member that absorbs energy of a collision by bending deformation. The former is required to be made of a material having a high toughness. This is because it is important not to deform but to keep the shape as the member even when receiving a collision. In contrast, the latter is required to be made of a material having a high bendability. This is because it is important to absorb the energy of a collision by bending deformation. In recent years, a component that combines these functions has been applied to a component such as a center pillar. Specifically, a tailored property member, in which a material having a deformation suppressing performance is used on its upper side of a component to keep an occupant space stably, and a material having an impact absorbing performance is used on its lower side to cause the member to deform actively, has been applied.

Patent Document 1 describes an invention relating to a hot stamped body that has a predetermined chemical composition and includes a microstructure including at least one of prior-austenite having an average grain diameter of 3 μm or less, lower bainite, martensite, and tempered martensite, at 90% or more in area fraction. According to the invention, by setting the average grain diameter of prior-austenite at 3 μm or less and by dissolving one or two of Nb and Mo in prior-austenite grain boundaries to increase embrittlement strength of the grain boundaries, an impact absorption performance more excellent than conventional ones is obtained.

Patent Document 2 describes an invention relating to a press-quenched steel component that has a predetermined chemical composition and includes a steel micro-structure including: less than 40% of bainite, less than 5% of austenite, and less than 5% of ferrite, with the balance being martensite, in which the martensite contains auto-tempered martensite. Patent Document 2 discloses that, by controlling a cooling rate for 750 to 450° C. after hot pressing to 40 to 360° C./s and controlling a cooling rate for 450 to 250° C. to 15 to 150° C./s, the steel micro-structure can be formed into a mixed structure of bainite and self-tempered (auto-tempered) martensite, and as a result, a strength of 950 to 1200 MPa in TS and a bendability shown by a bending angle, determined in conformity to VDA-238 bending standard, of more than 75 deg are obtained, which enables improvement in impact absorbed energy.

Patent Document 3 describes an invention relating to a steel component that has a predetermined chemical composition and has a steel micro-structure including at least one of 75% of equiaxed ferrite, martensite in an amount of 5% or more to 20% or less, and bainite in an amount of 10% or less.

LIST OF PRIOR ART DOCUMENTS

Patent Document

Patent Document 1: WO 2019/186931 A1
Patent Document 2: JP2018-527457A
Patent Document 3: JP2010-521584A

SUMMARY OF INVENTION

Technical Problem

According to the invention of Patent Document 1, the average grain diameter of prior-austenite is controlled to 3 μm or less by controlling conditions for hot finish rolling and a heating rate during hot stamping heating, but Patent Document 1 has no mention of auto-tempering of martensite.

According to the invention of Patent Document 2, setting a surface proportion of auto-tempered martensite at 5% or more is described, but Patent Document 2 only discloses that the measurement is performed by inspecting its cross section under an optical microscope or a scanning electron microscope and performing image analysis using a known method, which is unclear. Further, according to the invention of Patent Document 2, a ferrite amount is set at less than 5% so that a desired strength is obtained. In contrast, according to the invention of Patent Document 3, insular martensite is caused to be present in a ferrite matrix by setting a ferrite amount at 75% or more, so that tensile strength is improved without a decrease in ductility. However, a degree of the ductility remains at 23.5% at the highest.

The present invention has been made to solve the problems of the prior art and has an objective to provide a hot stamped body that has a tensile strength TS of 590 MPa or more to less than 980 MPa and has an excellent ductility and an excellent impact energy absorbing performance.

Conventionally, it has been considered that the absorption energy obtained until cracking occurs (that is, until the bending angle is maximized) is important for improving ductility and collision energy absorption performance of the hot stamped body. However, according to the studies by the present inventors, it was found that it is important to increase the crack propagation resistance in addition to the improvement of the bendability in order to further improve the collision energy absorption performance of the hot stamped body.

It was found that, in order to improve ductility, it is important to make the microstructure to have ferrite with an area ratio of 5 to 50%, and further, in order to increase crack propagation resistance, it is important to increase the proportion of auto-tempered martensite crystal grains (hereinafter, also referred to as "amount of auto-tempering") more than conventional one among the martensite in the microstructure of the hot stamped body.

Here, since the auto-temper is a phenomenon in which the crystal grains that have completed the martensitic transformation are tempered in order, the martensitic crystal grains that have been transformed at a low temperature are difficult to be tempered. In addition, since martensite produced at a low temperature is hard and brittle, sufficient tempering will increase the margin for improving mechanical properties.

In order to increase the amount of auto-temper more than conventional one, it was found that it is important to reduce the difference (Ms-M80) between a temperature at which martensitic transformation starts (Ms) and a temperature which brings about 80% completion of the martensitic transformation (M80). In order to reduce Ms-M80, it is important to keep the interfacial pressure applied to the blank at the time of hot stamping higher than usual. Although the reason is unknown exactly, it is presumed that austenite becomes unstable, and the martensitic transformation tends to proceed early by setting the interfacial pressure at the time of hot stamping within a predetermined range. Therefore, if the interfacial pressure is applied higher than usual, most of martensite is transformed at a relatively high temperature, and the amount of auto-temper is also increased. By applying the interfacial pressure in this way, it becomes possible to increase the amount of the auto-tempered crystal grains as compared with the prior art, and it is possible to improve the impact absorbed energy. Normally, in hot stamping, molding is performed in a state where the steel material is heated and softened. Molding with a high load increases the manufacturing cost, and therefore, in conventional method, molding has been performed with low interfacial pressure as possible. The present inventors have found the above-mentioned new findings contrary to such common general knowledge.

The present invention has been made based on the above findings, and the gist of the present invention is the following hot stamped body.

(1) A hot stamped body comprising a chemical composition consisting of: in mass %, C: 0.06% or more to less than 0.20%, Si: 0.010 to 1.00%, Mn: 0.80 to 2.00%, P: 0.100% or less, S: 0.010% or less, Al: 0.010 to 0.500%, N: 0.010% or less, Nb: more than 0.020% to 0.10% or less, Ti: 0 to 0.10%, V: 0 to 0.10%, Cr: 0 to 0.50%, Mo: 0 to 1.00%, B: 0 to 0.0100%, Ni: 0 to 0.50%, REM: 0 to 0.0100%, Mg: 0 to 0.010%, Ca: 0 to 0.0100%, and Co: 0 to 2.0%, with the balance: Fe and impurities, wherein a microstructure includes, in area fraction, ferrite: 5 to 50%, and martensite: 50 to 95%, a proportion of regions in the martensite where GAIQ values are 35000 or more to less than 45000 is 30 area % or more, and a maximum bending angle α (deg) according to VDA238-100 of German Association of the Automotive Industry is 90 or more.

(2) The hot stamped body according to the above described (1), wherein the chemical composition contains one or more elements selected from, in mass %:

Ti: 0.001 to 0.10%,

V: 0.001 to 0.100%,

Cr: 0.010 to 0.50%,

Mo: 0.010 to 1.000%,

B: 0.0001 to 0.010%,

Ni: 0.001 to 0.50%,

REM: 0.001 to 0.010%,

Mg: 0.001 to 0.010%,

Ca: 0.001 to 0.010%, and

Co: 0.01 to 2.0%.

(3) The hot stamped body according to the above described (1) or (2), wherein a tensile strength is 590 MPa or more to less than 980 MPa.

(4) The hot stamped body according to any one of the above described (1) to (3), wherein the hot stamped body is not heated to 350° C. or more after hot stamping forming.

(5) The hot stamped body according to any one of the above described (1) to (4), comprising a plating layer on an outer layer of the hot stamped body.

Advantageous Effect of Invention

According to the present invention, a hot stamped body that combines a strength of TS: 590 MPa or more to less than 980 MPa, a ductility as excellent as an elongation at break (total elongation) of 25% or more, a bendability as excellent as a maximum bending angle determined based on VDA 238-100 (April 2017 edition) of German Association of the Automotive Industry standard (hereinafter, simply referred to as "maximum bending angle"), denoted by α, of 90 (deg) or more, and an excellent crack propagation resistance is obtained.

DESCRIPTION OF EMBODIMENT

Figure 1:
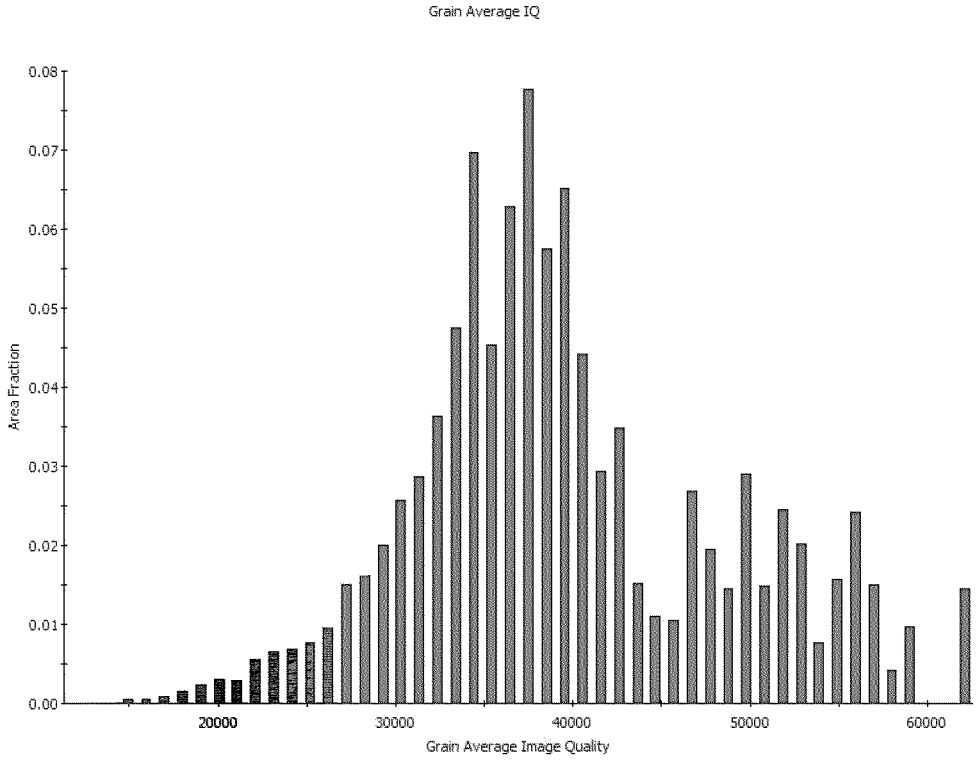
FIG. 1 illustrates a distribution (histogram) of GAIQ values of a test specimen in which auto-tempered grains and not auto-tempered grains are intermixed.

A hot stamped body according to the present embodiment and a method for producing the hot stamped body will be described below in detail.

<Chemical Composition of Hot Stamped Body>

First, reasons for limiting a chemical composition of a steel sheet from which the hot stamped body according to the present embodiment is formed will be described. Hereinafter, the symbols "%" used for the chemical composition all mean "mass %".

"C: 0.06% or more to less than 0.20%"

C is an important element for obtaining a tensile strength of 590 MPa or more to less than 980 MPa for the hot stamped body. If a content of C is less than 0.06%, martensite becomes soft, making it difficult to ensure a sufficient tensile strength, and thus the content of C is set at 0.06% or more. On the other hand, if the content of C is 0.20% or more, auto-tempering does not progress, and thus martensite becomes hard, decreasing a bendability of the hot stamped body, and thus the content of C is set at less than 0.20%. A preferable lower limit of the content of C is 0.07%, 0.08%, or 0.09%, and a preferable upper limit of the content of C is 0.17%, 0.15%, 0.13%, or 0.11%.

"Si: 0.010 to 1.00%"

Si has resistance to temper softening and thus has an effect of restraining a decrease in strength due to auto-tempering during hot stamp quenching. If a content of Si is less than 0.010%, the effect is not obtained, and there may be a case where the tensile strength is not obtained or a case where the bendability deteriorates, and thus the content of Si is set at 0.010% or more. When more than 1.00% of Si is contained, the $Ac_3$ point rises, and there may be a case where an austenite single phase does not develop during hot stamping heating, in which case microstructure of the hot stamped body becomes a nonuniform structure, causing a deterioration in bendability. The content of Si is therefore set at 1.00% or less. A preferable lower limit of the content of Si is 0.02%, 0.10%, 0.20%, or 0.30%, and a preferable upper limit of the content of Si is 0.90%, 0.80%, 0.70%, or 0.60%.

"Mn: 0.80 to 2.00%"

Mn is an element that increases a hardenability of steel and is useful in ensuring a tensile strength of 590 MPa or more with stability. If a content of Mn is less than 0.80%, the hardenability becomes insufficient, making it difficult to ensure the tensile strength of 590 MPa or more for the hot stamped body. The content of Mn is therefore set at 0.80% or more. On the other hand, if the content of Mn is set at more than 2.00%, microsegregation is promoted, making the steel micro-structure nonuniform, by which breakage is prone to occur, resulting in a decrease in bendability of the hot stamped body; therefore, 2.00% is set as the upper limit. A preferable lower limit of the content of Mn is 0.90%, 1.00%, 1.15%, or 1.30%, and a preferable upper limit of the content of Mn is 1.90%, 1.80%, or 1.60%.

"P: 0.100% or less"

P is an element that segregates at grain boundaries, decreasing a strength of the grain boundaries. If a content of P is more than 0.100%, a strength of grain boundaries is significantly decreased, decreasing a toughness and a bendability of the hot stamped body. The content of P is therefore set at 0.100% or less. An upper limit of the content of P is preferably 0.050%, 0.030%, 0.020%, or 0.015%. A lower limit of the content of P is not limited to a particular limit; however, if the content of P is reduced to less than 0.0001%, a cost of dephosphorization considerably increases, which is economically undesirable. In real operation, the content of P may be set at 0.0001% or more.

"S: 0.010% or less"

S is an element that forms inclusions in steel. If a content of S is more than 0.010%, a large quantity of inclusions, which serve as the origin of flex cracking, are formed in steel, decreasing a bendability of the hot stamped body. The content of S is therefore set at 0.010% or less. An upper limit of the content of S is preferably 0.0060%, 0.0040%, or 0.0030%. A lower limit of the content of S is not limited to a particular limit; however, if the content of S is reduced to less than 0.00015%, a cost of desulphurization considerably increases, which is economically undesirable. In real operation, the content of S may be set at 0.00015% or more.

"Al: 0.010 to 0.500%"

Al is an element that has an effect of deoxidizing molten steel to make the steel sound (suppress the occurrence of a defect such as a blowhole in the steel). If a content of Al is less than 0.010%, the deoxidation is not performed sufficiently; the content of Al is therefore set at 0.010% or more. A lower limit of the content of Al is preferably 0.010%, 0.020%, or 0.030%. On the other hand, if the content of Al is more than 0.500%, coarse oxides, which serve as the origin of flex cracking, are formed in steel, decreasing a bendability of the hot stamped body. The content of Al is therefore set at 0.500% or less. A preferable upper limit of the content of Al is 0.400%, 0.300%, 0.100%, or 0.080%.

"N: 0.010% or less"

N is an impurity element and is an element that forms nitrides, which serve as the origin of flex cracking, in steel, decreasing a bendability of the hot stamped body. If a content of N is more than 0.010%, coarse nitrides are formed in steel, significantly decreasing the bendability of the hot stamped body. The content of N is therefore set at 0.010% or less. An upper limit of the content of N is preferably 0.0075%, 0.0060%, or 0.0050%. A lower limit of the content of N is not limited to a particular limit; however, if the content of N is reduced to less than 0.0001%, a cost of denitrogenation considerably increases, which is economically undesirable. In real operation, the content of N may be set at 0.0001% or more.

"Nb: more than 0.020% to 0.10% or less"

Nb is an element that improves a strength of the hot stamped body by solid-solution strengthening and forms its carbo-nitride to contribute to refinement of prior-austenite grains, improving bendability. In order to exert the effects, the content of Nb is set at more than 0.020%. The content of Nb is more preferably 0.025%, 0.030%, 0.035%, or 0.040%. On the other hand, if Nb is contained at more than 0.10%, coarse Nb carbide is produced in steel, and there may be a case where a bendability of the hot stamped body is decreased; the content of Nb is therefore set at 0.10% or less. The content of Nb is more preferably 0.080%, 0.070%, or 0.060%.

"Ti: 0 to 0.10%"

Ti consumes dissolved nitride by forming its carbo-nitride, restraining formation of BN, so as to ensure an amount of dissolved B necessary for ensuring hardenability; therefore, Ti may be contained when necessary. A lower limit of a content of Ti is 0%. In order to obtain the effect, the content of Ti is preferably set at 0.001% or more. The content of Ti is more preferably 0.002% or more. On the other hand, if Ti is contained at more than 0.10%, coarse TiN, which serves as the origin of flex cracking, is produced, resulting in a deterioration in bendability. The content of Ti is preferably 0.10% or less. An upper limit of the content of Ti is more preferably 0.08%, 0.05%, or 0.03%.

"V: 0 to 0.10%"

V is an element that improves a strength of the hot stamped body by solid-solution strengthening. In addition, V is an element that forms its carbo-nitride, contributing to refinement of prior-austenite grain, improving bendability. Therefore, V may be contained when necessary. A lower limit of a content of V is 0%. In order to obtain the effects, the content of V is preferably set at 0.001% or more. The content of V is preferably 0.005% or more. If the content of V is more than 0.100%, refinement of austenitic grains progresses excessively, decreasing hardenability, and ferrite may be formed, decreasing a bendability of the hot stamped body. The content of V is therefore set at 0.100% or less. An upper limit of the content of V is preferably 0.08%, 0.05%, or 0.02%.

"Cr: 0 to 0.50%"

Cr is an element that increases hardenability and restrains formation of ferrite, which degrades bendability; therefore, Cr may be contained when necessary. A lower limit of a content of Cr is 0%. In order to obtain the effects, Cr is preferably contained at 0.010% or more. A more preferable lower limit of the content of Cr is 0.02%. However, Cr lowers the Ms point and is thus an element that restrains auto-tempering in a cooling process in hot stamping forming. The content of Cr is preferably set at 0.50% or less. An upper limit of the content of Cr is more preferably 0.40%, 0.20%, 0.10%, 0.05%, or 0.02%.

"Mo: 0 to 1.00%"

Mo is an element that improves a strength of the hot stamped body by solid-solution strengthening, increases a hardenability of steel, and restrains formation of ferrite, which degrades bendability; therefore, Mo may be contained when necessary. A lower limit of a content of Mo is 0%. In order to obtain the effects, Mo is preferably contained at 0.010% or more. A preferable lower limit of the content of Mo is 0.015%. On the other hand, containing Mo at more than 1.000% not only results in plateauing of the effect but also leads to an increase in an alloy cost; the content of Mo is therefore set at 1.000% or less. An upper limit of the content of Mo is more preferably 0.80%, 0.40%, 0.10%, 0.06%, or 0.03%.

"B: 0 to 0.0100%"

B is an element that segregates at grain boundaries to increase a hardenability of steel and therefore B may be contained when necessary. A lower limit of a content of B is 0%. In order to obtain the effects, B is preferably contained at 0.0001% or more. The content of B is preferably 0.0005% or more. On the other hand, if B is contained at more than 0.0100%, coarse BN, which serves as the origin of flex cracking, is formed, resulting in a deterioration in bendability. The content of B is therefore set at 0.0100% or less. An upper limit of the content of B is more preferably 0.0075%, 0.0040%, 0.0020%, 0.0015%, 0.0010%, or 0.0003%.

"Ni: 0 to 0.50%"

Ni is an element that is dissolved in austenite, increases a hardenability of steel, and is useful in ensuring a strength of 590 MPa or more with stability; therefore, Ni may be contained when necessary. A lower limit of a content of Ni is 0%. In order to obtain the effects, the content of Ni is preferably set at 0.001% or more. On the other hand, containing Ni at more than 0.50% results in plateauing of the effect and leads to an increase in an alloy cost; therefore, the content of Ni is preferably set at 0.50% or less. A preferable lower limit of the content of Ni is 0.01% and a preferable upper limit of the content of Ni is 0.40%, 0.20%, 0.10%, 0.07%, or 0.03%.

"REM: 0 to 0.0100%"

REM are elements that have an effect of deoxidizing molten steel to make the steel sound and improve bendability; therefore, REM may be contained when necessary. A lower limit of a content of REM is 0%. However, containing REM at their content being more than 0.010% only results in plateauing of the effect and leads to an increase in a cost; therefore, the content of REM is preferably set at 0.010% or less. A lower limit of the content of REM is preferably 0.0002% and more preferably 0.0005%. A preferable upper limit of REM is 0.0080%, 0.0050%, 0.0030%, or 0.0020%.

Note that, in the present embodiment, REM refer to 17 elements in total including Sc, Y, and lanthanoids. In the present embodiment, the content of REM refers to a total content of these elements.

"Mg: 0 to 0.010%"

Mg is an element that has an effect of deoxidizing molten steel to make the steel sound and improve bendability; therefore, Mg may be contained when necessary. A lower limit of the content of Mg is 0%. However, containing Mg at more than 0.010% only results in plateauing of the effect and leads to an increase in a cost; therefore, the content of Mg is preferably set at 0.010% or less. The lower limit of the content of Mg is preferably 0.0001% and more preferably 0.0005%. A preferable upper limit of Mg is 0.008%, 0.005%, or 0.003%.

"Ca: 0 to 0.010%"

Ca is an element that has an effect of deoxidizing molten steel to make the steel sound and improve bendability; therefore, Ca may be contained when necessary. A lower limit of the content of Ca is 0%. However, containing Ca at its content being more than 0.010% only results in plateauing of the effect and leads to an increase in a cost; therefore, the content of Ca is preferably set at 0.010% or less. The lower limit of the content of Ca is preferably 0.001% and more preferably 0.005%. A preferable upper limit of Ca is 0.0080%, 0.0050%, 0.0030%, or 0.0020%.

"Co: 0 to 2.0%"

Co is an element that has an effect of raising the Ms point and is an element that improves bendability; therefore, Co may be contained when necessary. A lower limit of the content of Co is 0%.

In order to exert the effects, the content of Co is preferably set at 0.01% or more. The content of Co is more preferably 0.02% or more. On the other hand, if the content of Co is more than 2.0%, a hardenability of steel is decreased, making it difficult to ensure a strength of 590 MPa or more; therefore, the content of Co is preferably 2.0% or less. An upper limit of the content of Co is more preferably 1.5%, 0.8%, 0.3%, or 0.1%.

The balance of the chemical composition of the hot stamped body according to the present embodiment consists of Fe and impurities. Examples of the impurities include elements that are unavoidably contained from row materials of steel or scrap and/or unavoidably contained in a steel-making process and that are allowed to be contained within ranges within which features of the hot stamped body according to the present embodiment are not affected.

<Microstructure of Hot Stamped Body>

Next, a microstructure of the hot stamped body according to the present embodiment will be described.

"The proportion of regions in martensite where GAIQ values are 35000 or more to less than 45000 is 30 area % or more"

The most striking feature of the present invention is that, in a cooling process in hot stamping forming, the microstructure is transformed into martensite, thereafter, martensite grains having a relatively high dislocation density are subjected to auto-tempering to be formed into grains having a relatively low dislocation density, so as to improve bendability. It is therefore important to determine a proportion of the auto-tempered martensite grains. Hence, the present inventors conducted studies about a method for measuring the proportion, conducted intensive studies about a method for determining the proportion of the auto-tempered martensite grains, and as a result, established the following method.

First, a steel micro-structure of a test specimen is measured by an electron backscatter diffraction method, and from among obtained measurement data, a steel microstructure with a bcc structure is analyzed in terms of a grain average image quality (GAIQ) parameter.

FIG. 1 illustrates a distribution (histogram) of GAIQ values of a test specimen in which auto-tempered grains and not auto-tempered grains are intermixed. When a GAIQ value is high, a dislocation density is low, and when a GAIQ value is low, a dislocation density is high; therefore, the GAIQ value is a parameter that is reflective of a dislocation density of grains. As illustrated in FIG. 1, it is understood that the histogram about the test specimen has two peaks including the highest peak and the second highest peak (near GAIQs of 34500 and 37500). That is, from the histogram of GAIQ values, it is possible to separate grains that have been made to have low dislocation densities by auto-tempering and grains that have not been auto-tempered and have dislocation densities being still high from each other. The tendency of a histogram about a specimen to have two peaks was confirmed in various kinds of materials. From this fact, for a hot stamped body having a mechanical strength and a steel micro-structure intended in the present invention, the present inventors determined that regions where GAIQ values are 35000 or more to less than 45000 are to be classified into auto-tempered martensite grains.

Note that, according to a metallographic investigation, it is confirmed that a region where GAIQ values are 45000 or more is mainly formed of ferrite. In addition, according to a similar investigation, it is confirmed that GAIQ values of bainite (upper bainite and lower bainite) are 35000 or more to less than 45000.

Figure 2:
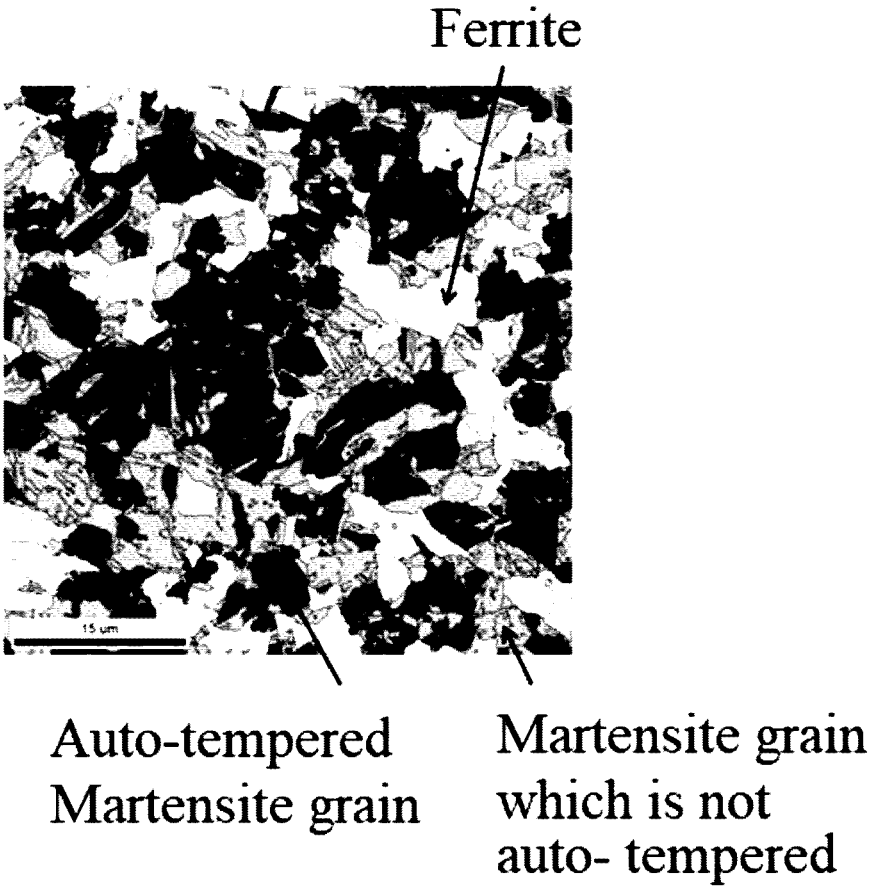
FIG. 2 illustrates a GAIQ map created for a hot stamped body of Test No. 9 in EXAMPLE by ternarization with a GAIQ values of 35000 and 45000 taken as boundary values.

FIG. 2 illustrates a GAIQ map created by ternarization with a GAIQ values of 35000 and 45000 taken as boundary values. With the GAIQ map illustrate in FIG. 2, it is possible to simply visualize grains that are made to have low dislocation densities by auto-tempering, consider "regions in martensite where GAIQ values are 35000 or more to less than 45000" to be regions where auto-tempered martensite grains are present, and calculate a proportion (area fraction) of the regions. In the present invention, a proportion of an area of regions where auto-tempered martensite grains are present to an area of martensite is calculated.

In the present invention, when the proportion of regions in martensite where GAIQ values are 35000 or more to less than 45000 is 30 area % or more, the number of auto-tempered martensite grains in the martensite can be increased sufficiently, and it is thus possible to improve a bendability of the hot stamped body. Note that the proportion is preferably 40 area % or more. On the other hand, although there is no specific constraint on an upper limit of the proportion, if the number of auto-tempered regions are in excess, there arises a problem in that the strength of 590 MPa or more cannot be ensured; therefore, the upper limit of the proportion of the regions in martensite where GAIQ values are 35000 or more to less than 45000 is preferably set at 95 area %, more preferably 90 area %.

The microstructure of the hot stamped body according to the present invention mainly contains, in area fraction, 5 to 50% of ferrite and 50 to 95% of martensite. In particular, the microstructure preferably contains, in area fraction, 60% or more of martensite, preferably 70% or more of martensite. That is, a lower limit of a total area fraction of martensite and ferrite is 65%. The lower limit is preferably 75%, 85%, or 90%, more preferably 95%, 98%, or 100%. Although there is no particular constraint on the steel micro-structure other than the ferrite and the martensite in the microstructure, the steel micro-structure other than the ferrite and the martensite includes upper bainite, lower bainite, retained austenite, and the like. In addition, iron carbide and the like may be contained. An upper limit of the remaining micro-structure, other than the martensite and the ferrite, is 35%, preferably 25%, 15%, or 10%, and more preferably 5%, 2%, or 0%, in area fraction. The remaining micro-structure can be defined as, for example, a steel micro-structure of one or more kinds selected from upper bainite, lower bainite, retained austenite, and iron carbide. Area fractions of the structures can be measured by the following method.

(Method for Measuring Area Fraction and GAIQ Value of Martensite)

(Method for Identifying Martensite)

A sample is taken from a position sufficiently away from an end face of the hot stamped body (typically, a position 50 mm or more away) such that a sheet-thickness cross section can be observed. This sheet-thickness cross section is taken as an observation surface. The observation surface of the sample is mirror polished, and then 10 indentations are made under an indentation load of 100 gf using a micro-Vickers durometer in a region centered about a t/4 sheet-thickness position of the sample (note that the region is limited to a region between a ⅛ sheet-thickness depth from a surface and a ⅜ sheet-thickness depth from the surface) so as to specify capturing positions under a scanning electron microscope. Next, a surface of the sample is immersed in an acetylacetone electrolyte to be subjected to electrolytic etching. This enables clarification of morphology of ferrous carbides in the steel micro-structure and can make a contrast of grain boundaries clear.

Next, a field emission scanning electron microscope (FE-SEM) equipped with a secondary electron detector is used to capture secondary electron images at ×5000 capturing magnification in each of the 10 visual fields at which the indentations have been made beforehand (note that an area of each visual field is set at 0.0001 $mm^2$ or more). In captured pictures obtained by this method, ferrite and hard phases (martensite, bainite, and retained austenite) are distinguished from each other.

Next, in order to discriminate martensite, upper bainite, and lower bainite from one another, secondary electron images are captured in the same visual fields at ×10000 capturing magnification. Upper bainite, lower bainite, and martensite can be discriminated from one another based on whether iron carbides are present in lath grains and based on directions of elongation of the iron carbides. Retained austenite is not etched sufficiently; therefore, an amount of retained austenite is measured by the method described below. Upper bainite is a steel micro-structure formed of aggregation of lath grains with precipitation of carbides between laths. Lower bainite and tempered martensite are also steel micro-structures formed of aggregation of lath grains but are steel micro-structures that contain carbides inside laths. Lower bainite and tempered martensite are discriminated from each other based on directions of elongation of the carbides. Carbides of lower bainite have a single variant; carbides present in one block make angular differences being within 5° and thus have substantially the same direction. In contrast, carbides of tempered martensite have a plurality of variants; carbides in one block elongate in a plurality of directions. From the difference, lower bainite and tempered martensite are discriminated from each other.

(Method for Measuring Area Fraction of Retained Austenite)

In the same regions as the observation regions in which the captured pictures are obtained, an area fraction of the retained austenite is measured. The observation surface is polished again using #600 to #1500 silicon carbide papers and then mirror polished. Next, the observation surface is polished with colloidal silica containing no alkaline solution at room temperature for eight minutes, by which strain introduced in an outer layer of the observation surface is relieved. The observation surface is measured by the electron backscatter diffraction method at 0.1 μm measurement intervals, by which crystal orientation information is obtained. For the measurement, an apparatus including a thermal field emission scanning electron microscope (JSM-7001F manufactured by JEOL) and an EBSD detector (DVC5 detector manufactured by TSL solutions) is used. At this time, a degree of vacuum in the apparatus is set at $9.6\times10^{-5}$ Pa or less, an accelerating voltage is set at 15 kv, an irradiation current level is set at 13, and an irradiation level of electron beams is set at 62. From the obtained crystal orientation information, an area fraction of retained austenite, which has an fcc structure, is calculated using the "Phase Map" function built in software "OIM Analysis®" that comes with an EBSD analyzer, by which the area fraction of retained austenite is obtained.

From the above, it is possible to distinguish, in the hard phase, martensite, tempered martensite, upper bainite, lower bainite, and retained austenite from one another; accordingly, an area fraction of total martensite can be determined by subtracting the area fractions of upper bainite, lower bainite, and retained austenite from the area fraction of the hard phase.

(Method for Measuring GAIQ Value)

In each of the 10 visual fields at which the indentations have been made beforehand (note that an area of each visual field is set at 0.0001 $mm^2$ or more), a grain average misorientation image quality map (GAIQ map) is obtained by using the "Grain Average Misorientation" function built in the software that comes with the EBSD analyzer. In the obtained GAIQ map, regions where GAIQ values are 35000 or more to less than 45000 are identified while targets for the GAIQ value analysis are limited to steel micro-structures having bcc structures (ferrite, martensite, and bainite). That is, the targets for the GAIQ value analysis do not include steel micro-structures other than those having bcc structures, for example, retained austenite having an fcc structure. As described above, the GAIQ values of bainite are 35000 or more to less than 45000, and the GAIQ values of ferrite are 45000 or more. Therefore, next, by removing bainite identified in the secondary electron images (capturing magnification: ×10000) using the "Highlight" function, the area fraction of martensite having GAIQ values of 35000 or more to less than 45000 is derived.

That is, first, images of bainite identified in the secondary electron images are recorded. Next, a GAIQ map is created from the same visual fields by EBSD, and hard steel micro-structures corresponding to GAIQ of 35000 or more to less than 45000 are extracted while targets for the GAIQ value analysis are limited to steel micro-structures having bcc structures (ferrite, martensite, and bainite). At this time point, ferrite having GAIQ of 45000 or more, and martensite and retained austenite having GAIQ of less than 35000 are excluded, and thus martensite and bainite having GAIQ of 35000 or more to less than 45000 are extracted. Further, from these steel micro-structures, the Highlight function of the OIM Analysis is used to identify martensite having the predetermined GAIQ values. The Highlight function is a function of extracting and displaying data on grains specified on the created map. Specifically, a secondary electron image and a GAIQ map are superimposed together, and regions that are determined to be bainite in the secondary electron image are excluded by the Highlight function. By the procedure described above, the remaining hard steel micro-structures are identified as martensite having GAIQ of 35000 or more to less than 45000.

The hot stamped body according to the present invention may include a plating layer on its surface. This is for suppressing formation of scales in a hot stamping step, improving corrosion resistance of a hot stamped member, and the like.

Examples of hot dipping include hot dip galvanizing, galvannealing, hot dip aluminizing, and in addition, hot dip aluminizing and galvanizing. If a hot-dipped layer is hard, a crack may occur in hot stamping forming, degrading a corrosion resistance of the hot stamped member. For this reason, the hot dipping is preferably hot dip galvanizing and galvannealing, which result in a soft plating layer.

In a case where the hot dipping is hot dip galvanizing or galvannealing, an adhered amount of plating on a surface of a steel sheet is preferably 3 to 800 $g/m^2$ per side. If the adhered amount of plating is less than 3 $g/m^2$ per side, it is difficult to obtain the advantageous effect of improving the corrosion resistance reliably. On the other hand, if the adhered amount of plating is more than 800 $g/m^2$ per side, a defect such as blowholes is prone to occur during welding. From the viewpoint of the improving the corrosion resistance and suppressing an increase in a cost, the adhered amount of plating is more preferably 10 to 200 $g/m^2$.

In particular, in order to preventing or reducing vaporization of a plating coating before hot stamping forming so as to improve the corrosion resistance of the hot pressed member, the plating is preferably galvannealed plating. As a galvannealing degree of the galvannealed plating, a content of Fe in the plating coating is preferably 3% or more to 25% or less. If the content of Fe in the plating coating is less than 3%, the vaporization of the plating coating during hot stamping forming cannot be prevented or reduced sufficiently; on the other hand, if the content of Fe in the plating coating is more than 25%, powdering properties of the hot stamped member deteriorate.

From the viewpoint of preventing or reducing the vaporization of the plating coating and ensuring the powdering properties, the content of Fe in the plating coating is more preferably 7 to 18%. Note that an organic or inorganic coating may be additionally formed on a surface of the zinc plating layer or the galvannealed layer.

<Tensile Strength, Etc. Of Hot Stamped Body>

A tensile strength TS of the hot stamped body according to the present embodiment is 590 MPa or more to less than 980 MPa. When necessary, a lower limit of the tensile strength TS may be set at 610 MPa, 640 MPa, 680 MPa, or 720 MPa, and an upper limit of the tensile strength TS may be set at 960 MPa, 920 MPa, 880 MPa, or 840 MPa. A maximum bending angle $\alpha$ (deg) of the hot stamped body according to the present embodiment is set at 90 or more. When necessary, the maximum bending angle $\alpha$ may be set at 95 or more, 98 or more, 101 or more, or 105 or more. Although there is no particular need to specify an upper limit of the maximum bending angle $\alpha$, the upper limit may be set at 180 or less, 150 or less, 130 or less, or 120 or less. A thickness of the hot stamped body according to the present embodiment may be set at about 0.3 to 6.0 mm, but there is no particular need to limit the thickness. When necessary, a lower limit of the thickness may be set at 0.4 mm, 0.6 mm, 0.8 mm, 1.0 mm, or 1.2 mm, and an upper limit of the thickness may be set at 5.0 mm, 4.5 mm, 4.0 mm, 3.6 mm, 3.2 mm, or 2.8 mm.

<Method for Producing Hot Stamped Body>

Next, a preferable method for producing the hot stamped body according to the present embodiment will be described. First, a method for producing a steel sheet for hot stamping that is applied to the hot stamped body according to the present embodiment will be described.

(Method for Producing Steel Sheet for Hot Stamping)

A slab having the chemical composition described above is prepared, and the steel sheet for hot stamping is produced by, for example, the following producing method.

"Heating Step"

The slab to be subjected to hot rolling is only required to be produced by a conventional method; for example, the slab is only required to be produced by a typical method such as continuous casting slab and a thin slab caster. The steel material having the chemical composition described above is subjected to the hot rolling, heated to 1200° C. or more in a hot rolling step, and subjected to a holding process at the temperature for 20 minutes or more. If the heating temperature is less than 1200° C. or if the holding continues for less than 20 minutes, remelting of coarse inclusions such as Ti does not progress, and the coarse inclusions remain to serve as a fracture origin; as a result, bendability may deteriorate. Preferably, the heat temperature is 1250° C. or more, and a holding duration is 25 minutes or more. A preferable upper limit of the heating temperature is 1350° C., and a preferable upper limit of the holding duration is 120 minutes.

"Finish Rolling Step"

It is preferable to next perform finish rolling in a temperature range not less than the $Ar_3$ point. If the finish rolling is ended at a temperature less than the $Ar_3$ point, the finish rolling is performed as intercritical rolling, and a sheet shape resulting from the rolling may deteriorate. Therefore, a finish rolling temperature is preferably the $Ar_3$ point or more and more preferably $Ar_3$+30° C. or more. A preferable upper limit of the finish rolling temperature is 1050° C. The $Ar_3$ point is expressed by Formula (1) shown below. In Formula (1), each symbol of an element indicates a content of the element (mass %).

$$Ar_3 \text{ point } (^\circ \text{ C.}) = 850 + 10 \times (C+N) \times Mn + 350 \times Nb + 250 \times Ti + 40 \times B + 10 \times Cr + 100 \times Mo \quad \text{Formula (1)}$$

"Coiling Step"

The steel sheet subjected to the finish rolling is coiled into a coil at 750° C. or less. If a coiling temperature is more than 750° C., scales are produced in a large quantity, which makes it difficult to remove the scales in a pickling step as the next step; therefore, the coiling temperature is set at 750° C. or less. The coiling temperature is preferably 600° C. or less. A preferable lower limit of the coiling temperature is 350° C.

The hot-rolled steel sheet may be subjected to reheating treatment for softening when necessary. In addition, the hot-rolled steel sheet may be subjected to cold rolling, continuous annealing, and continuous hot dip galvanizing steps.

As the cold rolling, performing cold rolling that is performed at a normal rolling reduction, for example, 30 to 90% will suffice.

In a case where a plating layer is to be formed on a surface of the cold-rolled sheet, various types of known hot dipping or electroplating may be performed in accordance with a purpose such as preventing or reducing the production of scales in the hot stamping step and improving the corrosion resistance of the hot stamped member.

(Method for Producing Hot Stamped Body)

From the steel sheet for hot stamping obtained in the manner described above, the hot stamped body is produced by, for example, the following producing method.

"Heating Step"

In the hot stamping step, heating is performed at an average heating rate of 150° C./s or less. If the average heating rate is more than 150° C./s, remelting of carbides does not progress, and a concentration of carbon in austenite becomes locally uneven, which causes unevenness in an amount of auto-tempering to form a nonuniform steel microstructure; as a result, bendability may deteriorate. The heating is preferably performed at 100° C./s or less. Although a lower limit of the heating rate is not limited to a particular heating rate, the lower limit is preferably 1° C./s or more and more preferably 2° C./s or more from the viewpoint of productivity. The heating temperature is set at not less than the $Ac_3$ point, and the steel sheet is retained in the temperature range for 10 to 300 seconds and then subjected to hot forming. If the heating temperature is less than the $Ac_3$ point, the heating is performed as intercritical heating, which causes precipitation of ferrite, producing a nonuniform steel micro-structure, and in addition, there arises a problem in that remelting of carbides does not progress, resulting in a deterioration in bendability. For this reason, the lower limit of the heating temperature is set at the $Ac_3$ point or more. The lower limit is preferably $Ac_3$+20° C. Although an upper limit of the heating temperature is not limited to a particular temperature, setting a higher temperature increases a heating cost; therefore, the upper limit of the heating temperature is set at $Ac_3$ point +100° C. or less from the viewpoint of production cost. The upper limit is preferably $Ac_3$ point +80° C. or less. The $Ac_3$ point is expressed by Formula (2) shown below. In Formula (2), each symbol of an element indicates a content of the element (mass %).

$$Ac_3 \text{ point } (^\circ \text{ C.}) = 910 - 203 \times Co^{0.5} + 66 \times Si - 25 \times Mn + 700 \times P - 11 \times Cr + 109 \times Al + 400 \times Ti - 15.2 \times Ni + 104 \times V + 31.5 \times Mo \quad \text{Formula (2)}$$

"Forming Step"

A forming step is performed at a temperature range of 650 to 800° C. such that an interfacial pressure P (MPa) satisfying a condition expressed by Formula (3) shown below is applied to the steel sheet for hot stamping. The interfacial pressure P is a pressing force per unit area applied to the steel sheet for hot stamping and is determined by Pressing force/Area of steel sheet for hot stamping.

$$-0.65Ms + 400 \leq P \leq 200 \quad \text{Formula (3)}$$

Ms in Formula (3) above can be determined by Formula (4) shown below.

$$Ms = 539 - 423(\%\ C) - 30(\%\ Mn) - 12(\%\ Cr) - 17(\%\ Ni) - 7.5(\%\ Mo) \quad \text{Formula (4)}$$

Here, when a sufficiently high interfacial pressure is applied to the steel sheet for hot stamping that is heated to an austenite zone to cause shearing deformation, stress concentration occurs at austenite grain boundaries, which causes martensitic transformation to proceed readily. As a result, a temperature which brings about 80% completion of the martensitic transformation ($M_{80}$) can be increased, and it is consequently possible to reduce a difference ($Ms-M_{80}$). When the formation is performed under such a condition, the martensitic transformation proceeds readily, and a temperature at which martensite grains are auto-tempered rises; it is therefore possible to increase a proportion of the auto-tempered martensite grains in the hot stamped body.

Accordingly, it is necessary to apply the interfacial pressure P of "−0.65Ms+400" or more to the steel sheet for hot stamping. On the other hand, a substantial upper limit of the interfacial pressure P is 200 MPa in view of the capacity of a press machine.

When the Ms point rises, a temperature at which martensitic transformation starts rises, with which the number of auto-tempered martensite grains is also increased. For this reason, the Ms point is preferably 250° C. or more and more preferably 290° C. or more. An upper limit of the Ms point is preferably set at 550° C. on the ground of restraining bendability from deteriorating due to coarsening of carbides with excessively promotion of auto-tempering. An upper limit of the Ms point is more preferably set at 500° C.

Here, for hot pressing, a relatively small press machine has been used. Reasons for this include that it is not easy to charging a heated steel sheet taken out from a heating apparatus into a large press machine having a very high pressing force while the steel sheet is at high temperature, for performing pressing, that processing using a large press machine greatly increases a production cost, that there is no need to use a large press machine because a steel sheet for hot stamping that is heated to the austenite zone is easily deformed to begin with, and the like. For these reasons, an interfacial pressure during conventional hot press working is very low, which is an interfacial pressure less than the lower limit of the range expressed by Formula (3) shown above.

"Cooling Step"

A cooling rate (average cooling rate) for a temperature range from a temperature after the hot stamping forming to 250° C. is preferably set at 20° C./s or more to 500° C./s or less. By controlling the cooling rate for the temperature range from the temperature after the hot stamping forming to 250° C. to 20° C./s or more to 500° C./s or less, it is possible to form the microstructure of the hot stamped body into martensite (tempered martensite). If the cooling rate is less than 20° C./s, quenching is not performed, soft phases such as ferrite are formed in the microstructure, and there may be a case where the tensile strength of the hot stamped body falls below 590 MPa. For this reason, the cooling rate is preferably set at 20° C./s or more. Preferably, the cooling rate is 30° C./s or more. On the other hand, if the cooling rate is more than 500° C./s, auto-tempering of martensite does not progress, and there may be a case where bendability deteriorates. For this reason, the cooling rate is set at 500° C./s or less. Preferably, the cooling rate is 300° C./s or less.

In contrast, it is important to lower a cooling rate for a temperature range of 250° C. or less as much as possible to increase a proportion of auto-tempered martensite grains. That is, within a temperature range from 250° C. to 100° C., the hot stamped body is cooled at an average cooling rate of 1° C./s or more to 50° C./s or less.

After the hot stamping forming, tempering may be performed in a temperature range of 100° C. to 350° C. for adjusting a strength. In order to increase the tensile strength of the hot stamped body, it is preferable not to heat the hot stamped body to 350° C. or more after the hot stamping forming. A heating temperature after the hot stamping forming may be set at 300° C. or less, 250° C. or less, or 200° C. or less when necessary. In addition, after the hot stamping forming, the body may be made to partly include a softened region for improving a deformability of the hot stamped body. The softened region here means, for example, a softened region provided in part of the body by partly tempering the part of the body (e.g., a flange part). Further, even when a sufficiently high interfacial pressure is applied during forming working, the hot stamped body having some shape may be made to have a region in which a value of Formula (3) above falls below the left side value of Formula (3). Such a region is also considered to be the softened region.

The present invention is intended to separate grains that are made to have low dislocation densities by auto-tempering and grains that have not been auto-tempered and have dislocation densities being still high from each other, by utilizing the fact that a grain having a lower dislocation density results in a high GAIQ value. However, dislocation densities of martensite grains decrease by performing tempering. For example, even in a case where the interfacial pressure during the hot stamping forming is low, and grains of the resultant hot stamped body have not been auto-tempered, tempering is thereafter performed in some cases. If the tempering temperature is relatively low (about 200° C.), GAIQ values become less than 35000; however, if the tempering temperature is relatively high (350° C. or more), the tensile strength TS of the hot stamped body may be decreased, or the GAIQ values may become 35000 or more to less than 45000. Between a body tempered at such a relatively high temperature and a body auto-tempered according to the present application, there is no difference in microstructure, and it has not been possible to detect the difference. However, it was found that the hot stamped body tempered at the high temperature in this manner deteriorates in mechanical properties, particularly bendability and does not have the performances required in the present invention, specifically, performances such that the maximum bending angle α (deg) is 90 or more.

EXAMPLE

Next, EXAMPLE of the present invention will be described; however, conditions described in EXAMPLE are merely an example of conditions that was adopted for confirming feasibility and effects of the present invention, and the present invention is not limited to this example of conditions. In the present invention, various conditions can be adopted as long as the conditions allow the objective of the present invention to be achieved without departing from the gist of the present invention.

Steels having chemical compositions shown in Table 1 were melted and subjected to continuous casting, the obtained cast pieces were retained at 1200° C. for 30 minutes then subjected to hot rolling under a condition of a finishing temperature of 970° C., and the resultant hot-rolled steel strips were coiled at 550° C. These hot-rolled steel strips were subjected to cold rolling under a condition of a total rolling reduction of 50%, by which steel sheets for hot stamping having a thickness of 1.6 mm were obtained. Some of the steel sheets for hot stamping were subjected to hot dip galvanizing, by which plated steel sheets for hot stamping were obtained. Each steel sheet for hot stamping and each plated steel sheet for hot stamping (hereinafter, collectively referred to as a "steel sheet for hot stamping) were subjected to hot stamping forming under conditions shown in Table 2, by which hot stamped bodies were obtained. Some of the hot stamped bodies were annealed.

The hot stamped bodies were subjected to the microstructure measurement by the measurement method described above. In addition, mechanical properties of the hot stamped bodies were measured. Results of the measurements are shown in Table 3. FIG. 2 illustrates a GAIQ map that was created for Test No. 9, which is an inventive steel, by ternarization with GAIQ values of 35000 and 45000 taken as boundary values. The mechanical properties of the hot stamped bodies were measured and evaluated by the following method.

"Tensile Strength and Ductility"

For a tensile strength and a ductility of the hot stamped body, a No. 5 test coupon described in JIS Z 2201:2011 was fabricated from a given position of each hot stamped body, and a tensile strength TS (MPa) and a total elongation T.EL (%) of the hot stamped body were measured in conformity to the test method described in JIS Z 2241:2011.

"Bendability"

Bendability was evaluated based on VDA238-100 (April 2017 edition) of German Association of the Automotive Industry under the following measurement conditions. In the present invention, the maximum bending angle α was determined by converting a displacement at a maximum load obtained by a bending test into an angle in accordance with the VDA standard. A case where a was 90 (deg) or more was determined to be good in the bending test.

(Measurement Conditions)

- Test specimen dimensions: 60 mm (rolling direction)×60 mm (direction perpendicular to rolling direction)
- Bending line: A punch was pressed such that a bending line extends in a direction perpendicular to the rolling direction.
- Test method: Roll supported, punch press Roll diameter: ϕ30 mm Punch shape: Tip R=0.4 mm Roll distance: 2.0×Sheet thickness (mm)+0.5 mm Cross head speed for testing: 20 mm/min Test machine: SIMADZU AUTOGRAPH 20 kN "Crack Propagation Resistance"

Crack propagation resistance was evaluated by the following method. From the hot stamped steel sheets (hot stamped bodies), Charpy specimens having a sheet thickness of 1.2 mm, a length of 55 mm, and a width of 10 mm were taken. A longitudinal direction of each specimen was set to be a rolling direction, and a V notch having a length of 2 mm was processed in a direction perpendicular to the rolling direction. Three of the fabricated specimens were stacked and fixed with screws and subjected to an instrumental impact test. The instrumental impact test was conducted at room temperature, and a time from the start to the end of the test and an impulsive force were measured. From products of test speeds and measured times in the instrumental impact test, displacements were calculated. Lengths of fracture surfaces of the Charpy specimens were 8 mm, and thus an average value of impulsive forces observed in regions where displacements were 8 mm or more was taken as a background. After the background is subtracted from impulsive forces at all measurement points, an impulsive force—displacement curve was created.

Figure 3:
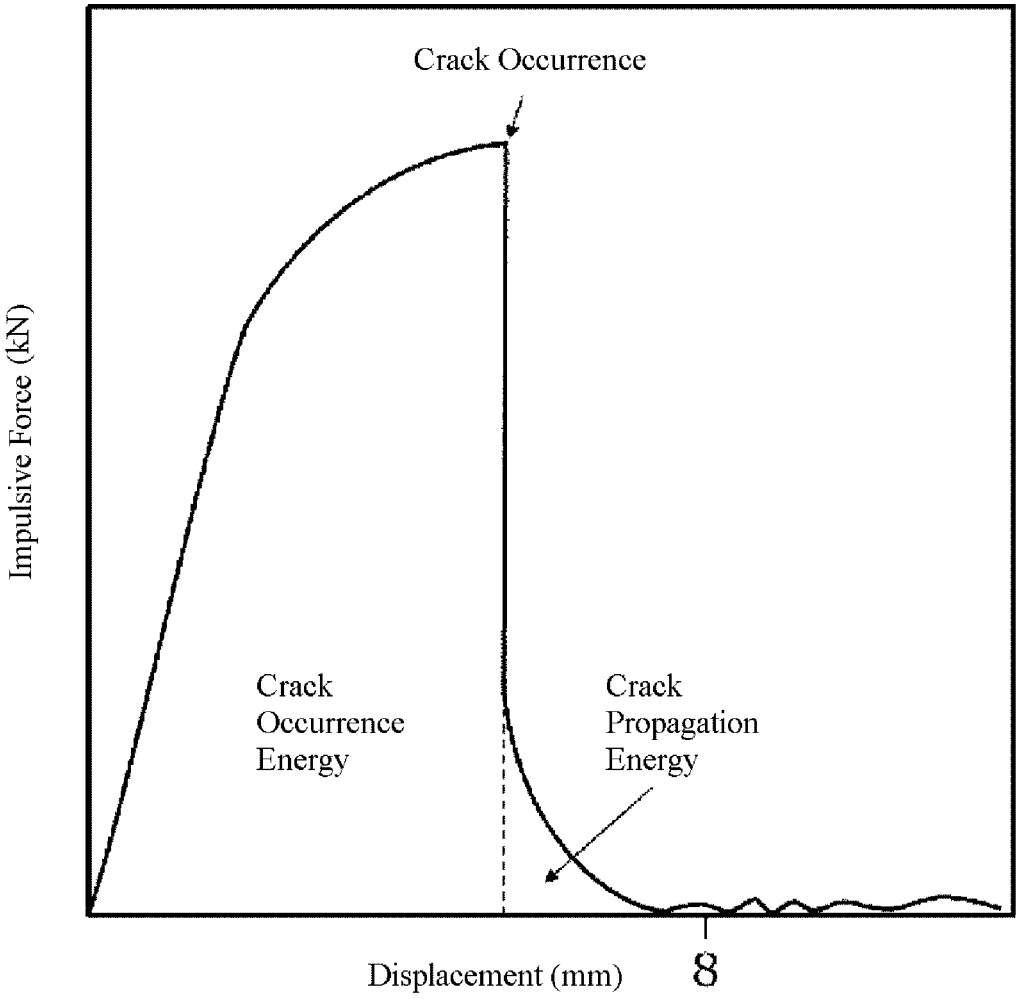
FIG. 3 illustrates a schematic diagram of the impulsive force—displacement curve.

FIG. 3 illustrates a schematic diagram of the impulsive force—displacement curve. From the resultant impulsive force—displacement curve, an area under the curve from a displacement of 0 mm to a displacement of 8 mm was calculated, and the resultant value was used as a total impact energy. Next, an impulsive force at which a steep decline of the impulsive force—displacement curve starts (at a crack occurrence in FIG. 3) was sought, and a correspondence displacement (a displacement of the crack occurrence) was determined. An area under the curve for a displacement of 0 mm to the displacement of the crack occurrence was calculated and used as a crack occurrence energy. A value obtained by subtracting the crack occurrence energy from a total absorbed energy was used as a crack propagation energy. A ratio of the crack propagation energy to the total impact energy was used as an index of a propagation resistance to crack. A case where this ratio of the crack propagation energy to the total impact energy is 10% or more was determined to be excellent in propagation resistance to crack and rated as good (○), and a case where the ratio is less than 10% was rated as poor (x).

"Evaluation Method"

A case where the tensile strength was 590 MPa or more to less than 980 MPa, and the total elongation T.EL (%) was 25% or more, and that was good in a bendability test and in crack propagation resistance was determined to be excellent in strength, ductility, bendability, and crack propagation resistance. A case that failed to satisfy any one of the four performances described above was determined to be poor in strength, ductility, bendability, and crack propagation resistance.

TABLE 1

| Steel | Chemical composition of steel sheet for hot stamping (mass % balance Fe and impurities) | | | | | | | | | | | |
|---|---|---|---|---|---|---|---|---|---|---|---|---|
| No. | C | Si | Mn | P | S | Al | N | Nb | Ti | V | Cr | Mo |
| 1 | 0.05 | 0.44 | 1.48 | 0.012 | 0.0051 | 0.046 | 0.0054 | 0.058 | | | | |
| 2 | 0.06 | 0.45 | 1.49 | 0.008 | 0.0039 | 0.025 | 0.0070 | 0.044 | | | | |
| 3 | 0.14 | 0.46 | 1.86 | 0.008 | 0.0056 | 0.025 | 0.0071 | 0.021 | | | | |
| 4 | 0.19 | 0.40 | 1.38 | 0.012 | 0.0043 | 0.033 | 0.0069 | 0.035 | | | | |
| 5 | 0.21 | 0.39 | 0.81 | 0.007 | 0.0038 | 0.026 | 0.0052 | 0.041 | | | | |
| 6 | 0.06 | 0.005 | 1.78 | 0.007 | 0.0019 | 0.033 | 0.0067 | 0.035 | | | | |
| 7 | 0.10 | 0.03 | 1.48 | 0.012 | 0.0042 | 0.040 | 0.0061 | 0.036 | | | | |
| 8 | 0.09 | 0.55 | 1.83 | 0.011 | 0.0022 | 0.049 | 0.0069 | 0.022 | | | | |
| 9 | 0.10 | 0.95 | 1.56 | 0.007 | 0.0036 | 0.023 | 0.0056 | 0.021 | | | | |
| 10 | 0.07 | 1.25 | 1.90 | 0.012 | 0.0036 | 0.038 | 0.0049 | 0.050 | | | | |
| 11 | 0.09 | 0.46 | 0.70 | 0.010 | 0.0041 | 0.023 | 0.0076 | 0.042 | | | | |
| 12 | 0.19 | 0.99 | 1.85 | 0.007 | 0.0027 | 0.046 | 0.0059 | 0.070 | | | | |
| 13 | 0.07 | 0.47 | 0.98 | 0.009 | 0.0027 | 0.043 | 0.0078 | 0.041 | | | | |
| 14 | 0.08 | 0.45 | 0.83 | 0.011 | 0.0051 | 0.045 | 0.0042 | 0.038 | | | | |
| 15 | 0.10 | 0.52 | 2.20 | 0.008 | 0.0040 | 0.024 | 0.0064 | 0.036 | | | | |
| 16 | 0.07 | 0.45 | 1.36 | 0.120 | 0.0036 | 0.031 | 0.0067 | 0.034 | | | | |
| 17 | 0.09 | 0.40 | 1.99 | 0.007 | 0.0200 | 0.050 | 0.0075 | 0.031 | | | | |
| 18 | 0.07 | 0.47 | 1.55 | 0.009 | 0.0031 | 0.006 | 0.0074 | 0.058 | | | | |
| 19 | 0.14 | 0.46 | 1.27 | 0.009 | 0.0044 | 0.54 | 0.0064 | 0.049 | | | | |
| 20 | 0.08 | 0.48 | 1.82 | 0.007 | 0.0030 | 0.025 | 0.0120 | 0.044 | | | | |
| 21 | 0.06 | 0.35 | 1.37 | 0.012 | 0.0043 | 0.027 | 0.0059 | 0.018 | | | | |
| 22 | 0.09 | 0.23 | 1.17 | 0.007 | 0.0018 | 0.040 | 0.0045 | 0.120 | 0.010 | | 0.05 | |
| 23 | 0.10 | 0.45 | 1.85 | 0.006 | 0.0025 | 0.047 | 0.0044 | 0.079 | 0.016 | | | |
| 24 | 0.08 | 0.46 | 1.23 | 0.012 | 0.0012 | 0.030 | 0.0073 | 0.074 | | 0.03 | | |
| 25 | 0.09 | 0.49 | 1.21 | 0.007 | 0.0037 | 0.027 | 0.0043 | 0.059 | | | 0.20 | |
| 26 | 0.09 | 0.53 | 1.44 | 0.006 | 0.0059 | 0.023 | 0.0069 | 0.080 | | | | 0.10 |
| 27 | 0.08 | 0.44 | 1.24 | 0.010 | 0.0031 | 0.164 | 0.0079 | 0.061 | | | | |
| 28 | 0.07 | 0.44 | 0.92 | 0.014 | 0.0028 | 0.023 | 0.0062 | 0.067 | | | | |
| 29 | 0.07 | 0.49 | 1.47 | 0.010 | 0.0037 | 0.042 | 0.0054 | 0.076 | | | | |
| 30 | 0.08 | 0.50 | 1.39 | 0.009 | 0.0011 | 0.048 | 0.0076 | 0.057 | | | | |
| 31 | 0.07 | 0.45 | 1.00 | 0.013 | 0.0060 | 0.270 | 0.0055 | 0.041 | | | | |
| 32 | 0.08 | 0.49 | 1.41 | 0.007 | 0.0060 | 0.030 | 0.0041 | 0.068 | | | | |

TABLE 1-continued

| Steel No. | Chemical composition of steel sheet for hot stamping (mass % balance Fe and impurities) B | Ni | REM | Mg | Ca | Co | $Ac_3$ (° C.) | Ms (° C.) | remarks |
|---|---|---|---|---|---|---|---|---|---|
| 1 | | | | | | | 870 | 473 | Compar. steel |
| 2 | | | | | | | 861 | 469 | Invention steel |
| 3 | | | | | | | 826 | 424 | Invention steel |
| 4 | | | | | | | 826 | 417 | Invention steel |
| 5 | | | | | | | 830 | 426 | Compar. steel |
| 6 | | | | | | | 824 | 460 | Compar. steel |
| 7 | | | | | | | 824 | 452 | Invention steel |
| 8 | | | | | | | 853 | 446 | Invention steel |
| 9 | | | | | | | 877 | 450 | Invention steel |
| 10 | | | | | | | 904 | 452 | Compar. steel |
| 11 | | | | | | | 872 | 480 | Compar. steel |
| 12 | | | | | | | 850 | 403 | Invention steel |
| 13 | | | | | | | 874 | 480 | Invention steel |
| 14 | | | | | | | 874 | 480 | Invention steel |
| 15 | | | | | | | 833 | 431 | Compar. steel |
| 16 | | | | | | | 939 | 469 | Compar. steel |
| 17 | | | | | | | 836 | 441 | Compar. steel |
| 18 | | | | | | | 855 | 463 | Compar. steel |
| 19 | | | | | | | 898 | 442 | Compar. steel |
| 20 | | | | | | | 846 | 451 | Compar. steel |
| 21 | | | | | | | 861 | 473 | Compar. steel |
| 22 | 0.0020 | | | | | | 848 | 465 | Compar. steel |
| 23 | | | | | | | 847 | 443 | Invention steel |
| 24 | | | | | | | 867 | 468 | Invention steel |
| 25 | | | | | | | 857 | 462 | Invention steel |
| 26 | | | | | | | 858 | 457 | Invention steel |
| 27 | 0.0014 | | | | | | 875 | 468 | Invention steel |
| 28 | | 0.05 | | | | | 874 | 481 | Invention steel |
| 29 | | | 0.0020 | | | | 863 | 465 | Invention steel |
| 30 | | | | 0.001 | | | 863 | 463 | Invention steel |
| 31 | | | | | 0.0015 | | 899 | 479 | Invention steel |
| 32 | | | | | | 1.0 | 858 | 463 | Invention steel |

The underline means that it is out of the scope specified in the present invention.

TABLE 2

| Test No. | Steel No. | Plating | Hot stamp condition $Ac_3$ (° C.) | Heating rate (° C./s) | Heating temp. (° C.) | Holding time (s) | Forming temp. (° C.) | Inter-facial pressure (MPa) | Ms (° C.) | −0.65 Ms + 400 (MPa) | Cooling rate between (° C./s) | Cooling rate between 250 (° C./s) | Annealing to hot (° C.) | remarks |
|---|---|---|---|---|---|---|---|---|---|---|---|---|---|---|
| 1 | 1 | No | 870 | 8 | 940 | 180 | 724 | 100 | 473 | 92.3 | 100 | 35 | No | Compar. steel |
| 2 | 2 | No | 861 | 6 | 920 | 180 | 710 | 135 | 469 | 95.2 | 100 | 45 | No | Invention steel |
| 3 | 3 | No | 826 | 11 | 900 | 180 | 689 | 185 | 424 | 124.4 | 60 | 25 | No | Invention steel |
| 4 | 4 | No | 826 | 4 | 880 | 300 | 655 | 150 | 417 | 128.8 | 30 | 20 | No | Invention steel |
| 5 | 5 | No | 830 | 7 | 920 | 60 | 733 | 145 | 426 | 123.2 | 300 | 15 | No | Compar. steel |
| 6 | 6 | No | 824 | 6 | 840 | 120 | 690 | 110 | 460 | 100.9 | 100 | 35 | No | Compar. steel |
| 7 | 7 | Yes | 824 | 8 | 860 | 240 | 662 | 125 | 452 | 106.0 | 200 | 35 | No | Invention steel |
| 8 | 8 | No | 853 | 6 | 920 | 240 | 683 | 120 | 446 | 110.1 | 30 | 10 | No | Invention steel |
| 9 | 9 | No | 877 | 7 | 960 | 240 | 710 | 135 | 450 | 107.6 | 100 | 15 | No | Invention steel |
| 10 | 10 | No | 904 | 6 | 960 | 120 | 676 | 165 | 452 | 105.9 | 60 | 15 | No | Compar. steel |
| 11 | 11 | Yes | 872 | 4 | 960 | 120 | 660 | 130 | 480 | 88.0 | 5 | 45 | No | Compar. steel |
| 12 | 12 | No | 850 | 11 | 900 | 240 | 726 | 195 | 403 | 138.0 | 450 | 25 | No | Invention steel |
| 13 | 13 | Yes | 874 | 8 | 900 | 60 | 713 | 130 | 480 | 88.0 | 30 | 45 | No | Invention steel |
| 14 | 14 | No | 874 | 144 | 880 | 240 | 732 | 145 | 480 | 87.8 | 100 | 15 | No | Invention steel |
| 15 | 15 | No | 833 | 4 | 900 | 60 | 722 | 170 | 431 | 120.0 | 300 | 45 | No | Compar. steel |
| 16 | 16 | No | 939 | 7 | 1000 | 180 | 722 | 115 | 469 | 95.4 | 60 | 45 | No | Compar. steel |
| 17 | 17 | No | 836 | 10 | 900 | 60 | 683 | 135 | 441 | 113.2 | 450 | 20 | No | Compar. steel |
| 18 | 18 | No | 855 | 5 | 920 | 240 | 717 | 170 | 463 | 99.1 | 100 | 40 | No | Compar. steel |
| 19 | 19 | No | 898 | 5 | 980 | 240 | 746 | 160 | 442 | 112.9 | 60 | 10 | No | Compar. steel |
| 20 | 20 | No | 846 | 7 | 900 | 180 | 690 | 165 | 451 | 107.1 | 100 | 45 | No | Compar. steel |
| 21 | 21 | No | 861 | 5 | 960 | 180 | 719 | 140 | 473 | 92.9 | 60 | 20 | No | Compar. steel |
| 22 | 22 | Yes | 848 | 4 | 880 | 180 | 740 | 180 | 465 | 97.6 | 30 | 45 | No | Compar. steel |
| 23 | 23 | Yes | 847 | 107 | 860 | 240 | 658 | 140 | 443 | 111.8 | 200 | 25 | No | Invention steel |
| 24 | 24 | No | 867 | 5 | 960 | 240 | 699 | 115 | 468 | 95.6 | 60 | 45 | No | Invention steel |
| 25 | 25 | No | 857 | 9 | 920 | 240 | 698 | 150 | 462 | 99.6 | 60 | 40 | No | Invention steel |
| 26 | 26 | No | 858 | 6 | 900 | 240 | 675 | 180 | 457 | 103.0 | 60 | 10 | No | Invention steel |
| 27 | 27 | No | 875 | 11 | 920 | 300 | 670 | 155 | 468 | 95.8 | 30 | 40 | 200 | Invention steel |
| 28 | 28 | No | 874 | 12 | 920 | 60 | 663 | 105 | 481 | 87.4 | 100 | 20 | No | Invention steel |

TABLE 2-continued

| Test No. | Steel No. | Plating | Hot stamp condition: $Ac_3$ (° C.) | Heating rate (° C./s) | Heating temp. (° C.) | Holding time (s) | Forming temp. (° C.) | Inter-facial pressure (MPa) | Ms (° C.) | −0.65 Ms + 400 (MPa) | Cooling rate between (° C./s) | Cooling rate between 250 (° C./s) | Annealing to hot (° C.) | remarks |
|---|---|---|---|---|---|---|---|---|---|---|---|---|---|---|
| 29 | 29 | No | 863 | 11 | 960 | 240 | 664 | 165 | 465 | 97.6 | 450 | 30 | No | Invention steel |
| 30 | 30 | No | 863 | 7 | 940 | 120 | 697 | 140 | 463 | 98.8 | 30 | 20 | 200 | Invention steel |
| 31 | 31 | No | 899 | 12 | 920 | 60 | 654 | 140 | 479 | 88.4 | 60 | 25 | No | Invention steel |
| 32 | 32 | No | 858 | 33 | 880 | 300 | 744 | 120 | 463 | 99.1 | 200 | 20 | No | Invention steel |
| 33 | 23 | Yes | 847 | 12 | 820 | 120 | 658 | 190 | 443 | 111.8 | 450 | 20 | No | Compar. steel |
| 34 | 23 | Yes | 847 | 5 | 880 | 60 | 692 | 100 | 443 | 111.8 | 30 | 30 | No | Compar. steel |
| 35 | 23 | Yes | 847 | 52 | 880 | 240 | 663 | 210 | 443 | 111.8 | — | | No | Compar. steel |
| 36 | 23 | Yes | 847 | 5 | 920 | 60 | 650 | 130 | 443 | 111.8 | 15 | 40 | No | Compar. steel |
| 37 | 23 | Yes | 847 | 10 | 880 | 300 | 733 | 130 | 443 | 111.8 | 210 | 20 | No | Compar. steel |
| 38 | 23 | Yes | 847 | 5 | 940 | 180 | 675 | 190 | 443 | 111.8 | 100 | 60 | No | Compar. steel |
| 39 | 27 | No | 875 | 10 | 850 | 240 | 703 | 125 | 468 | 95.8 | 100 | 10 | No | Compar. steel |
| 40 | 27 | No | 875 | 10 | 980 | 120 | 666 | 80 | 468 | 95.8 | 30 | 45 | No | Compar. steel |
| 41 | 27 | No | 875 | 4 | 940 | 180 | 731 | 215 | 468 | 95.8 | — | | No | Compar. steel |
| 42 | 27 | No | 875 | 4 | 960 | 180 | 688 | 155 | 468 | 95.8 | 10 | 30 | No | Compar. steel |
| 43 | 27 | No | 875 | 7 | 920 | 60 | 690 | 115 | 468 | 95.8 | 550 | 35 | NO | Compar. steel |
| 44 | 27 | No | 875 | 5 | 900 | 300 | 741 | 105 | 468 | 95.8 | 200 | 70 | No | Compar. steel |
| 45 | 23 | Yes | 847 | 5 | 880 | 60 | 695 | 25 | 443 | 111.8 | 30 | 30 | 400 | Compar. steel |
| 46 | 27 | No | 875 | 5 | 980 | 120 | 670 | 40 | 468 | 95.8 | 35 | 30 | 500 | Compar. steel |
| 47 | 4 | No | 826 | 10 | 880 | 300 | 650 | 25 | 417 | 128.8 | 30 | 20 | 200 | Compar. steel |
| 48 | 9 | No | 877 | 7 | 970 | 260 | 700 | 135 | 450 | 107.6 | 50 | 15 | No | Invention steel |
| 49 | 12 | No | 850 | 10 | 910 | 250 | 725 | 195 | 403 | 138.0 | 50 | 25 | No | Invention steel |
| 50 | 12 | No | 850 | 10 | 910 | 250 | 724 | 195 | 403 | 138.0 | 50 | 25 | 200 | Invention steel |

Underline means it is outside the scope specified in the present invention or recommended manufacturing conditions.

TABLE 3

| Test No. | Steel No. | Hot stamped body Microstructure (area %): Ferrite | Martensite | Bainite + retained Austenite | ① | Mechanical properties: TS (MPa) | Elongation (%) | Bendability α (deg) | Crack propagation properties | remarks |
|---|---|---|---|---|---|---|---|---|---|---|
| 1 | 1 | 28 | 72 | 0 | 69 | 569 | 37 | 120 | ○ | Compar. steel |
| 2 | 2 | 12 | 88 | 0 | 83 | 641 | 34 | 111 | ○ | Invention steel |
| 3 | 3 | 21 | 79 | 0 | 62 | 755 | 27 | 104 | ○ | Invention steel |
| 4 | 4 | 17 | 83 | 0 | 45 | 745 | 29 | 100 | ○ | Invention steel |
| 5 | 5 | 6 | 94 | 0 | 28 | 1030 | 18 | 84 | X | Compar. steel |
| 6 | 6 | 11 | 89 | 0 | 90 | 578 | 35 | 120 | ○ | Compar. steel |
| 7 | 7 | 24 | 76 | 0 | 68 | 776 | 31 | 112 | ○ | Invention steel |
| 8 | 8 | 11 | 89 | 0 | 73 | 871 | 32 | 108 | ○ | Invention steel |
| 9 | 9 | 25 | 75 | 0 | 65 | 751 | 29 | 114 | ○ | Invention steel |
| 10 | 10 | 80 | 20 | 0 | 15 | 532 | 33 | 69 | X | Compar. steel |
| 11 | 11 | 60 | 40 | 0 | 28 | 621 | 31 | 81 | X | Compar. steel |
| 12 | 12 | 6 | 94 | 0 | 65 | 838 | 27 | 95 | ○ | Invention steel |
| 13 | 13 | 41 | 59 | 0 | 87 | 715 | 28 | 121 | ○ | Invention steel |
| 14 | 14 | 42 | 58 | 0 | 67 | 897 | 27 | 99 | ○ | Invention steel |
| 15 | 15 | 49 | 51 | 0 | 58 | 719 | 29 | 95 | X | Compar. steel |
| 16 | 16 | 29 | 71 | 0 | 89 | 825 | 29 | 103 | X | Compar. steel |
| 17 | 17 | 38 | 62 | 0 | 70 | 676 | 31 | 99 | X | Compar. steel |
| 18 | 18 | 45 | 55 | 0 | 83 | 922 | 26 | 103 | X | Compar. steel |
| 19 | 19 | 6 | 94 | 0 | 60 | 874 | 31 | 103 | X | Compar. steel |
| 20 | 20 | 34 | 66 | 0 | 76 | 691 | 34 | 99 | X | Compar. steel |
| 21 | 21 | 3 | 97 | 0 | 73 | 693 | 23 | 105 | ○ | Compar. steel |
| 22 | 22 | 55 | 45 | 0 | 25 | 793 | 27 | 85 | X | Compar. steel |
| 23 | 23 | 24 | 76 | 0 | 84 | 899 | 27 | 96 | ○ | Invention steel |
| 24 | 24 | 7 | 93 | 0 | 90 | 677 | 32 | 118 | ○ | Invention steel |
| 25 | 25 | 27 | 73 | 0 | 75 | 663 | 30 | 116 | ○ | Invention steel |
| 26 | 26 | 12 | 88 | 0 | 76 | 643 | 31 | 117 | ○ | Invention steel |
| 27 | 27 | 28 | 72 | 0 | 75 | 732 | 31 | 107 | ○ | Invention steel |
| 28 | 28 | 16 | 84 | 0 | 73 | 917 | 26 | 118 | ○ | Invention steel |
| 29 | 29 | 43 | 57 | 0 | 74 | 776 | 28 | 110 | ○ | Invention steel |
| 30 | 30 | 9 | 91 | 0 | 76 | 600 | 30 | 111 | ○ | Invention steel |
| 31 | 31 | 15 | 85 | 0 | 72 | 871 | 28 | 113 | ○ | Invention steel |
| 32 | 32 | 10 | 90 | 0 | 79 | 768 | 31 | 124 | ○ | Invention steel |
| 33 | 23 | 56 | 44 | 0 | 26 | 972 | 26 | 82 | X | Compar. steel |
| 34 | 23 | 33 | 67 | 0 | 27 | 695 | 31 | 108 | X | Compar. steel |
| 35 | 23 | | — | | | | | — | | Compar. steel |
| 36 | 23 | 62 | 38 | 0 | 90 | 570 | 37 | 105 | X | Compar. steel |

TABLE 3-continued

| Test No. | Steel No. | Hot stamped body Microstructure (area %) Ferrite | Martensite | Bainite + retained Austenite | ① | Mechanical properties TS (MPa) | Elongation (%) | Bendability α (deg) | Crack propagation properties | remarks |
|---|---|---|---|---|---|---|---|---|---|---|
| 37 | 23 | 16 | 84 | 0 | 25 | 914 | 28 | 95 | X | Compar. steel |
| 38 | 23 | 31 | 69 | 0 | 29 | 790 | 29 | 107 | X | Compar. steel |
| 39 | 27 | 66 | 34 | 0 | 20 | 799 | 33 | 79 | X | Compar. steel |
| 40 | 27 | 38 | 62 | 0 | 28 | 936 | 26 | 102 | X | Compar. steel |
| 41 | 27 | | — | | | | | — | | Compar. steel |
| 42 | 27 | 70 | 30 | 0 | 90 | 540 | 35 | 131 | ○ | Compar. steel |
| 43 | 27 | 9 | 91 | 0 | 23 | 751 | 28 | 100 | X | Compar. steel |
| 44 | 27 | 27 | 73 | 0 | 26 | 917 | 26 | 101 | X | Compar. steel |
| 45 | 23 | 32 | 68 | 0 | 85 | 620 | 33 | 88 | X | Compar. steel |
| 46 | 27 | 25 | 75 | 0 | 90 | 611 | 31 | 85 | X | Compar. steel |
| 47 | 4 | 19 | 81 | 0 | 29 | 769 | 26 | 80 | X | Compar. steel |
| 48 | 9 | 23 | 67 | 10 | 70 | 715 | 31 | 118 | ○ | Invention steel |
| 49 | 12 | 5 | 70 | 25 | 67 | 789 | 28 | 115 | ○ | Invention steel |
| 50 | 12 | 5 | 71 | 24 | 75 | 774 | 28 | 117 | ○ | Invention steel |

Underline means it is outside the scope or evaluation criteria specified in the present invention.

① means the ratio of GAIQ value in martensite is 35,000 or more and less than 45,000.

As shown in Tables 1 to 3, examples satisfying the conditions defined in the present invention were all excellent in mechanical properties. Examples not satisfying the conditions defined in the present invention were all poor in mechanical properties.

In Test No. 1, its content of C fell below the lower limit of the content of C; therefore, its martensite became soft, failing to obtain the tensile strength of 590 MPa or more. In Test No. 5, its content of C exceeded the upper limit of the content of C; therefore, the amount of auto-tempering was decreased, a tensile strength of 980 MPa or more was exerted, and its bendability and crack propagation resistance deteriorated. In Test No. 6, its content of Si fell below the lower limit of the content of Si; therefore, the resistance to temper softening was not obtained, failing to obtain the tensile strength of 590 MPa or more. In Test No. 10, its content of Si exceeded the upper limit of the content of Si; therefore, an austenite single phase did not develop during hot stamping heating, ferrite was produced excessively, and as a result, its area fraction of regions in martensite where GAIQ was 35000 or more to less than 45000 was less than 30%, failing to secure a sufficient amount of auto-tempering. In Test No. 11, its content of Mn fell below the lower limit of the content of Mn; therefore, its hardenability deteriorated, and ferrite was produced excessively. As a result, securing a sufficient amount of auto-tempering failed, and its crack propagation resistance deteriorated.

In Test No. 15, its content of Mn exceeded the upper limit of the content of Mn; therefore, its crack propagation resistance deteriorated due to microsegregation. In Test No. 16, its content of P exceeded the upper limit of the content of P; therefore, its grain boundary strength was decreased due to grain-boundary segregation, resulting in a deterioration in crack propagation resistance. In Test No. 17, its content of S exceeded the upper limit of the content of S; therefore, inclusions were produced in a large quantity, resulting in a deterioration in crack propagation resistance. In Test No. 18, its content of Al fell below the lower limit of the content of Al; therefore, blowholes were formed in its steel, resulting in a deterioration in crack propagation resistance. In Test No. 19, its content of Al exceeded the upper limit of the content of Al; therefore, coarse Al oxides were produced, resulting in a deterioration in crack propagation resistance. In Test No. 20, its content of N exceeded the upper limit of the content of N; therefore, coarse nitrides were produced, resulting in a deterioration in crack propagation resistance. In Test No. 21, its content of Nb fell below the lower limit of the content of Nb; therefore, steel microstructures of prior-austenite grains became coarse to increase its hardenability, and ferrite was produced little, resulting in a decrease in elongation.

In Test No. 22, its content of Nb exceeded the upper limit of the content of Nb; therefore, ferrite was produced excessively, and securing a sufficient amount of auto-tempering failed, resulting in a deterioration in crack propagation resistance. In Test No. 33, its hot stamping heating temperature was excessively low; therefore, austenitizing did not progress sufficiently, and ferrite was produced excessively, resulting in a deterioration in crack propagation resistance. In Test No. 34, its interfacial pressure fell below the lower limit of the interfacial pressure; therefore, the amount of auto-tempering was insufficient, resulting in a decrease in crack propagation resistance. In Test No. 35, its load exceeds the pressing capability, failing to perform the formation; therefore, its microstructure and its mechanical properties were not able to be evaluated. In Test No. 36, its cooling rate for the formation to 250° C. fell below the lower limit of the cooling rate; therefore, quenching was not performed, failing to obtain the tensile strength of 590 MPa or more.

In Test No. 37, its cooling rate for the formation to 250° C. exceeded the upper limit of the cooling rate; therefore, the amount of auto-tempering was insufficient, resulting in a deterioration in crack propagation resistance. In Test No. 38, its cooling rate for 250 to 100° C. exceeded the upper limit of the cooling rate; therefore, the amount of auto-tempering was insufficient, resulting in a deterioration in crack propagation resistance. In Test No. 39, its hot stamping heating temperature was excessively low; therefore, austenitizing did not progress sufficiently, ferrite was produced excessively, and as a result, the amount of auto-tempering was insufficient, resulting in a deterioration in crack propagation resistance. In Test No. 40, its interfacial pressure fell below the lower limit of the interfacial pressure; therefore, the amount of auto-tempering was insufficient, resulting in a deterioration in crack propagation resistance. In Test No. 41, its load exceeds the pressing capability, failing to perform the formation; therefore, its microstructure and its mechanical properties were not able to be evaluated. In Test No. 42, its cooling rate for the formation to 250° C. fell below the lower limit of the cooling rate; therefore, quenching was not performed, failing to obtain the tensile strength of 590 MPa or more.

In Test No. 43, its cooling rate for the formation to 250° C. exceeded the upper limit of the cooling rate; therefore, the amount of auto-tempering was insufficient, resulting in a deterioration in crack propagation resistance. In Test No. 44, its cooling rate for 250 to 100° C. exceeded the upper limit of the cooling rate; therefore, the amount of auto-tempering was insufficient, resulting in a deterioration in crack propagation resistance. In Test Nos. 45 and 46, the condition that regions where GAIQ of 35000 or more to less than 45000 account for 30% or more in area fraction was satisfied by high temperature tempering after the hot stamping forming. However, in these examples, their interfacial pressures fell below the lower limit of the interfacial pressure; therefore, the amount of auto-tempering was insufficient, and carbides coarsened to serve a flex cracking origin, promoting crack propagation, resulting in a deterioration in bendability. In Test No. 47, its interfacial pressure fell below the lower limit of the interfacial pressure; therefore, although tempering was performed after the hot stamping forming, the amount of auto-tempering was insufficient, resulting in a deterioration in bendability.

In addition, it is understood that, as illustrated in FIG. 2, in Test No. 9, which is an inventive steel, the number of auto-tempered martensite grains, that is, regions having low dislocation densities is large (area fraction of 65%) compared to the number of grains not auto-tempered.

INDUSTRIAL APPLICABILITY

According to the present invention, a hot stamped body that combines a strength of TS: 590 MPa or more to less than 980 MPa, a ductility as excellent as an elongation at break (total elongation): 25% or more, a bendability as excellent as a: 90 deg or more, and an excellent crack propagation resistance is obtained.

The invention claimed is:

1. A hot stamped body comprising
a chemical composition comprising: in mass %,
C: 0.06% or more to less than 0.20%,
Si: 0.010 to 1.00%,
Mn: 0.80 to 2.00%,
P: 0.100% or less,
S: 0.010% or less,
Al: 0.010 to 0.500%,
N: 0.010% or less,
Nb: more than 0.020% to 0.10% or less,
Ti: 0 to 0.10%,
V: 0 to 0.10%,
Cr: 0 to 0.50%,
Mo: 0 to 1.00%,
B: 0 to 0.0100%,
Ni: 0 to 0.50%,
REM: 0 to 0.0100%,
Mg: 0 to 0.010%,
Ca: 0 to 0.0100%, and
Co: 0 to 2.0%,
with the balance: Fe and impurities, wherein
a microstructure includes, in area fraction,
ferrite: 5 to 50%, and
martensite: 50 to 95%,
a proportion of regions in the martensite where GAIQ values are 35000 or more to less than 45000 is 30 area % or more, and
a maximum bending angle α (deg) according to VDA238-100 of German Association of the Automotive Industry is 90° or more.

2. A hot stamped body comprising
a chemical composition consisting of: in mass %,
C: 0.06% or more to less than 0.20%,
Si: 0.010 to 1.00%,
Mn: 0.80 to 2.00%,
P: 0.100% or less,
S: 0.010% or less,
Al: 0.010 to 0.500%,
N: 0.010% or less,
Nb: more than 0.020% to 0.10% or less,
Ti: 0 to 0.10%,
V: 0 to 0.10%,
Cr: 0 to 0.50%,
Mo: 0 to 1.00%,
B: 0 to 0.0100%,
Ni: 0 to 0.50%,
REM: 0 to 0.0100%,
Mg: 0 to 0.010%,
Ca: 0 to 0.0100%, and
Co: 0 to 2.0%,
with the balance: Fe and impurities, wherein
a microstructure includes, in area fraction,
ferrite: 5 to 50%, and
martensite: 50 to 95%,
a proportion of regions in the martensite where grain average image quality (GAIQ) values are 35000 or more to less than 45000 is 30 area % or more, and
a maximum bending angle α (deg) according to VDA238-100 of German Association of the Automotive Industry is 90° or more.

3. The hot stamped body according to claim 2, wherein the chemical composition contains one or more elements selected from, in mass %:
Ti: 0.001 to 0.10%,
V: 0.001 to 0.100%,
Cr: 0.010 to 0.50%,
Mo: 0.010 to 1.000%,
B: 0.0001 to 0.010%,
Ni: 0.001 to 0.50%,
REM: 0.001 to 0.010%,
Mg: 0.001 to 0.010%,
Ca: 0.001 to 0.010%, and
Co: 0.01 to 2.0%.

4. The hot stamped body according to claim 3, wherein a tensile strength is 590 MPa or more to less than 980 MPa.

5. The hot stamped body according to claim 4, wherein the hot stamped body is not heated to 350° C. or more after hot stamping forming.

6. The hot stamped body according to claim 5, comprising a plating layer on an outer layer of the hot stamped body.

7. The hot stamped body according to claim 4, comprising a plating layer on an outer layer of the hot stamped body.

8. The hot stamped body according to claim 3, wherein the hot stamped body is not heated to 350° C. or more after hot stamping forming.

9. The hot stamped body according to claim 8, comprising a plating layer on an outer layer of the hot stamped body.

10. The hot stamped body according to claim 3, comprising a plating layer on an outer layer of the hot stamped body.

11. The hot stamped body according to claim 2, wherein a tensile strength is 590 MPa or more to less than 980 MPa.

12. The hot stamped body according to claim 11, wherein the hot stamped body is not heated to 350° C. or more after hot stamping forming.

13. The hot stamped body according to claim 12, comprising a plating layer on an outer layer of the hot stamped body.

14. The hot stamped body according to claim 11, comprising a plating layer on an outer layer of the hot stamped body.

15. The hot stamped body according to claim 2, wherein the hot stamped body is not heated to 350° C. or more after hot stamping forming.

16. The hot stamped body according to claim 15, comprising a plating layer on an outer layer of the hot stamped body.

17. The hot stamped body according to claim 2, comprising a plating layer on an outer layer of the hot stamped body.

* * * * *